US007231670B2

(12) United States Patent
Chang

(10) Patent No.: US 7,231,670 B2
(45) Date of Patent: Jun. 19, 2007

(54) VERSATILE SCARF

(76) Inventor: Lily Y. Chang, 24 Courthouse Sq., PH 8, Rockville, MD (US) 20850

( * ) Notice: Subject to any disclaimer, the term of this patent is extended or adjusted under 35 U.S.C. 154(b) by 0 days.

(21) Appl. No.: 11/411,725

(22) Filed: Apr. 27, 2006

(65) Prior Publication Data

US 2006/0253959 A1 Nov. 16, 2006

Related U.S. Application Data

(60) Provisional application No. 60/680,077, filed on May 12, 2005.

(51) Int. Cl.
*A42B 5/00* (2006.01)

(52) U.S. Cl. ..... 2/207

(58) Field of Classification Search ..... 2/207, 2/202–204, 91

See application file for complete search history.

(56) References Cited

U.S. PATENT DOCUMENTS

| | | | | | |
|---|---|---|---|---|---|
| 2,117,973 | A | | 5/1938 | Misewicz et al. | |
| 2,130,933 | A | * | 9/1938 | Sweet | 2/203 |
| 2,385,791 | A | * | 10/1945 | Bye | 2/91 |
| 2,413,318 | A | | 12/1946 | Golfieri | |
| 2,421,934 | A | * | 6/1947 | Golfieri | 2/204 |
| 2,462,727 | A | * | 2/1949 | Danelz | 2/91 |
| 2,464,007 | A | * | 3/1949 | Towle | 2/91 |
| 2,942,274 | A | * | 6/1960 | Ross | 2/91 |
| 3,080,566 | A | | 3/1963 | Neumann | |
| 3,088,119 | A | * | 5/1963 | Grant | 2/207 |
| 3,231,900 | A | * | 2/1966 | Gettinger | 2/207 |
| 3,360,802 | A | | 1/1968 | Kasamatsu | |
| 3,605,121 | A | | 9/1971 | Suzuki | |
| 3,668,707 | A | * | 6/1972 | Williams | 2/207 |
| 3,733,614 | A | | 5/1973 | Abramowitz | |
| 3,748,661 | A | * | 7/1973 | Smith | 2/207 |
| 3,894,296 | A | * | 7/1975 | Hirschbeck | 2/144 |
| 3,935,597 | A | * | 2/1976 | Frechmann et al. | 2/207 |
| 4,037,340 | A | | 7/1977 | Owensmith | |
| 4,277,849 | A | * | 7/1981 | Spears | 2/144 |
| 4,321,709 | A | * | 3/1982 | Steinberg | 2/207 |
| 4,654,897 | A | | 4/1987 | Rosaen | |
| 4,788,722 | A | * | 12/1988 | Oliver | 2/207 |
| 4,870,707 | A | * | 10/1989 | Hayes | 2/207 |
| 4,942,627 | A | * | 7/1990 | Copprue | 2/207 |
| 5,025,508 | A | | 6/1991 | Duncan | |
| 5,144,696 | A | * | 9/1992 | Kahl | 2/207 |
| 5,233,704 | A | | 8/1993 | Booher | |
| 5,454,121 | A | | 10/1995 | Mellinger | |
| D374,545 | S | * | 10/1996 | Cionni | D2/500 |

(Continued)

*Primary Examiner*—Alissa Hoey

(57) ABSTRACT

A versatile scarf includes an elongated rectangular neckband portion, a large half-fan shaped flap connected to one side of the neckband portion and a small half-fan shaped flap connected to another side of the neckband portion forming draping portions, and a loop coupled between the small flap and the neckband portion. Both sides of the scarf have the same configuration, therefore the scarf is completely reversible. The scarf can be securely tied by pulling the large flap through the loop between the neckband and the small flap, without using other fastening means. Depending on how far the large flap is pulled, through front or back loop, from top or bottom of the loop, re-looping or not, and depending on which side is showing and the position of the scarf, numerous stylish and distinctive appearances can be achieved. The dimensions of the scarf can be varied to suit different purposes.

7 Claims, 5 Drawing Sheets

U.S. PATENT DOCUMENTS

| | | | | |
|---|---|---|---|---|
| 5,643,643 | A | | 7/1997 | Bernstein |
| 5,797,144 | A | * | 8/1998 | Ciccone ..... 2/144 |
| D397,836 | S | * | 9/1998 | Inspector ..... D2/501 |
| 5,802,618 | A | | 9/1998 | Mustata |
| 5,867,835 | A | | 2/1999 | Dabbieri |
| 6,032,292 | A | | 3/2000 | Wood et al. |
| 6,065,156 | A | | 5/2000 | Murphy |
| 6,145,131 | A | | 11/2000 | Huff |
| 6,185,749 | B1 | | 2/2001 | Williams |
| 6,226,799 | B1 | * | 5/2001 | Lane ..... 2/207 |
| 6,256,793 | B1 | * | 7/2001 | Arias et al. ..... 2/207 |
| 6,519,778 | B2 | | 2/2003 | Arias et al. |
| D486,953 | S | * | 2/2004 | Hall ..... D2/500 |
| D529,682 | S | * | 10/2006 | Strong ..... D2/501 |
| 7,117,544 | B2 | * | 10/2006 | Kanitz ..... 2/207 |

* cited by examiner

VERSATILE SCARF

CROSS-REFERENCE TO RELATED APPLICATIONS

This application claims priority from U.S. Provisional Application No. 60/680,077 filed on May 12, 2005, the whole disclosure of which is hereby incorporated herein by reference.

BACKGROUND OF THE INVENTION

1. Field of Invention

The present invention relates in general to fabric fashion accessories and, more particularly, to fabric scarves or body wraps that can be worn around the neck, shoulder, waist, hip or head of a user, and also used as fashion enhancers for decorating handbags or hats.

2. Description of the Prior Art

For many people, daily dressing is a routine. For others, it is an opportunity to express themselves, and their unique sense of style. A scarf is a great accessory for any occasion and can extend the versatility of a woman's wardrobe, and also has purposes beyond just keeping the body warm or hiding the signs of aging on the neck. A scarf conveys an individual's personality and interests as well. There have been scarves and scarf-related designs previously patented, and these conventional scarves are usually made from a single piece of material having a square, rectangular, or triangular configuration. The scarves disclosed by U.S. Pat. Nos. 5,867,835 and 6,145,131 are scarves comprising a continuous circle made of tubular fabric. Other configurations such as those in discussed in U.S. Pat. Nos. 2,385,791, 2,942,274, 3,080,566, 3,360,802, 3,605,121, 4,277,849, 4,321,709, 4,788,722, 4,870,707, and 4,942,627 show different ways to tie a scarf of a special shape around the neck, head or waist of the user.

Ross's "Scarf and Method for Forming the Same" (U.S. Pat. No. 2,942,274) discloses a scarf having two square display panes connected by a neck strip. Ross's scarf could be used as a neck accessory or a scarf. Spears's "Elongated Garment for Women and Girls" (U.S. Pat. No. 4,277,849) discloses a scarf having an intermediate section of constant width and two outer sections flaring out to present different shapes. Steinberg's "Decorative Scarf" (U.S. Pat. No. 4,321,709) discloses a scarf having an elongated neck portion with one end provided with a narrow tubular opening, and the other end provided with a wider rectangular section. Copprue's "Scarf" (U.S. Pat. No. 4,942,627) discloses a scarf having a square portion and a rectangular portion integrally connected to each other, and a loop is formed in a free end of the rectangular portion.

The present invention improves upon the design of existing scarves by providing a versatile garment of varied appearance.

SUMMARY OF THE INVENTION

Accordingly, an aspect of the present invention is to provide an improved scarf design which creates a wide variety of appearances, especially for women and girls. This reversible scarf includes a flap on either side of the neckband of the scarf, and can be readily manipulated by the wearer into numerous shapes and styles, without any separate holding mechanisms such as rings, clasps, clips, pins or elastic bands for maintaining the scarf in a particular shape and position.

Another aspect of the present invention is to provide a versatile scarf which can achieve numerous stylish looks.

A further aspect of the present invention is to provide a scarf with a small loop which facilitates pulling of the scarf flap. The versatile scarf of the present invention not only lets users enjoy the fun in creating their unique tying methods, but also eliminates the chance of embarrassment of two people wearing the same scarf at the same time and at the same place. For traveling ladies, the versatile scarf of exemplary embodiments of the present invention is the best addition to their luggage to enhance the appearance of many different outfits.

The present invention is not limited to the above aspects, and those skilled in the art will appreciate other aspects of the present invention from the following description.

According to an exemplary embodiment of the present invention, there is provided a fabric fashion accessory which provides a multi-purpose, multi-style wrap which does not rely on any other holding mechanisms for maintaining a particular shape or position. The fabric fashion accessory functions mainly as a scarf for the neck or head, or as a fashion enhancer for a hat or handbag. However, the dimensions of the scarf of exemplary embodiments of the present invention can be changed and the scarf may be also used as a shawl, waist wrap, hip wrap, etc.

According to another exemplary embodiment of the present invention, a versatile scarf is provided, the scarf comprising an elongated scarf body (the neckband) having a large half-fan shaped flap on one end and a small half-fan shaped flap on another end. The top of the scarf body is a straight line, and the two half-fan shaped flaps at either end of the neckband drape down with curves and taper around the neckline of a wearer. A loop of the same material as that of the scarf body is positioned between the small half-fan shaped flap and the neckband which tightens the small half-fan shaped flap to configure into the shape of a fan. The loop may be sewn or otherwise attached between the small half-fan shaped flap and the neckband. The versatile scarf is reversible, and as such, two pieces of material having the same configuration, which compliment each other in color or pattern, may be used for the front portion and the back portion, and the two pieces of material are sewn or attached together to make a double-sided scarf.

The length of the neckband, width of the neckband and dimensions of the two flaps may vary, depending on applications and usage.

In order to tie the scarf of an exemplary embodiment of the present invention, the user pulls the large half-fan shaped flap through the loop between the neckband portion and the small half-fan shaped flap. The scarf is then securely tied, due in part to the scarf having a loop of a small opening and also due in part to the thickness of the large flap. Depending on how far the large half-fan shaped flap is pulled, whether through the front loop or through the back loop, through the top or bottom of the loop, re-looping or not re-looping, and depending on which side is showing and based on the position of the scarf, numerous stylish appearances can be achieved with the same versatile scarf of exemplary embodiments of the present invention.

BRIEF DESCRIPTION OF THE DRAWINGS

The above and other aspects of the present invention will be more apparent from the following detailed description taken in conjunction with the accompanying drawings, in which.

DETAILED DESCRIPTION OF EXEMPLARY EMBODIMENTS OF THE INVENTION

The present invention will now be described more fully with reference to the accompanying drawings, in which exemplary embodiments of the invention are shown, wherein like reference numbers refer to like elements throughout the specification. In the specification, alphabets designate corner parts, and numerals designate the body parts of the versatile scarf.

The reversible scarf of exemplary embodiments of the present invention is a fashion accessory wearable as neckwear apparel, headdress, and hat band, and in larger sizes as a shawl or body wrap.

Figure 1A:
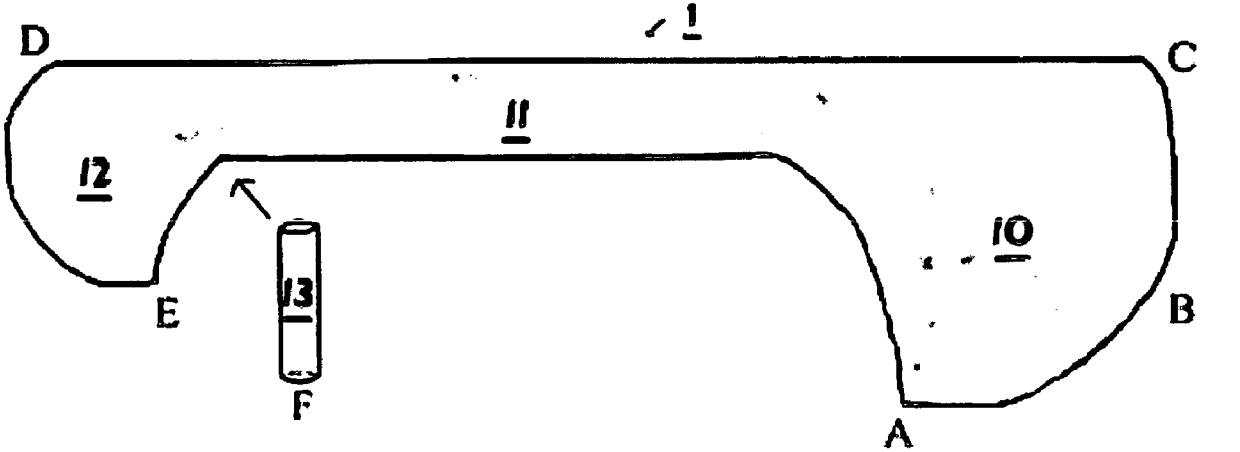
FIGS. 1A and 1B are perspective views of the versatile scarf body (A, B, C, D, E), a neckband with a large flap connected to a first end and a small flap connected to a second end, and two loops, a first loop F (front portion), and a second loop G (back portion), according to an exemplary embodiment of the present invention.
Figure 1B:
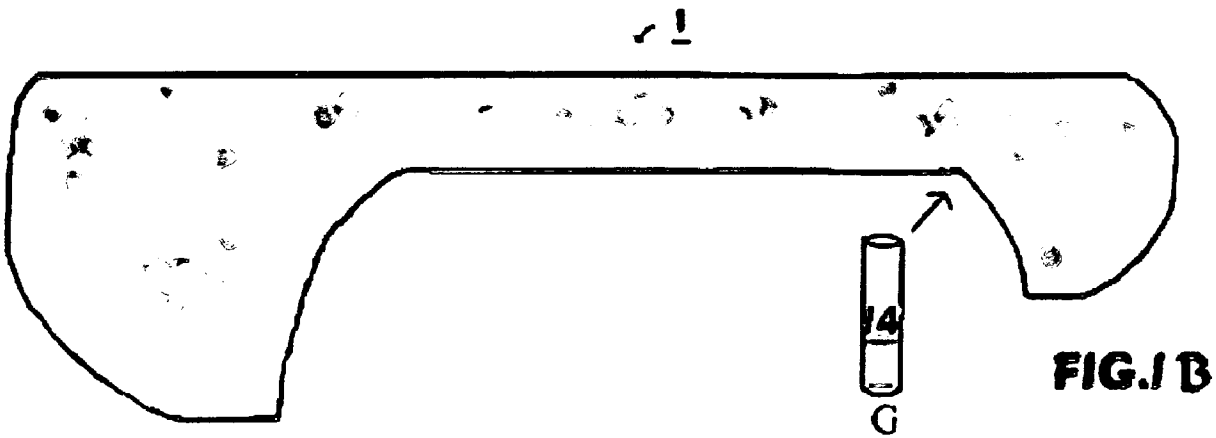

As shown in FIG. 1, the versatile scarf 1 of an exemplary embodiment of the present invention comprises a first portion 10, a second portion 11, a third portion 12 and a fourth portion 13. The first portion 10, second portion 11 and third portion 12 are integrally connected together. The first portion 10 comprises a large fan-shaped flap (A, B, C). The second portion 11 comprises an elongated neckband which may be rectangular in shape. The third portion 12 comprises a small fan-shaped flap (D, E). The fourth portion 13 comprises a first loop portion F and a second loop portion G, in combination a tubular loop portion, made of a material the same as or different from any of the first through third portions 10 to 12 of scarf 1. First loop portion F (13) is shown in front view FIG. 1A and second loop portion G (14) is shown in rear view FIG. 1B. The tubular loop may be flattened and sewn onto the scarf 1 between the second portion 11 and third portion 12, so that the first loop portion F is attached to the front portion of the scarf and the second loop portion G is attached to the back portion of the scarf, thus cinching the small flap of the third portion 12 into a fan shape and providing a tubular loop to secure the tied scarf, as shown in FIGS. 2A to 2C.

The front view of the scarf 1 is shown in FIG. 1A, and the back view is shown in FIG. 1B. The versatile scarf 1 is double-sided and reversible, and at least two pieces of complimentary or color coordinated fabrics, having the same configuration, may be attached to one another to form a completely reversible scarf.

The front view of the scarf 1 is shown in FIG. 1A, and the back view is shown in FIG. 1B. The versatile scarf 1 is double-sided and reversible, and at least two pieces of complimentary or color coordinated fabrics may be required to manufacture the complete scarf.

Figure 2A:
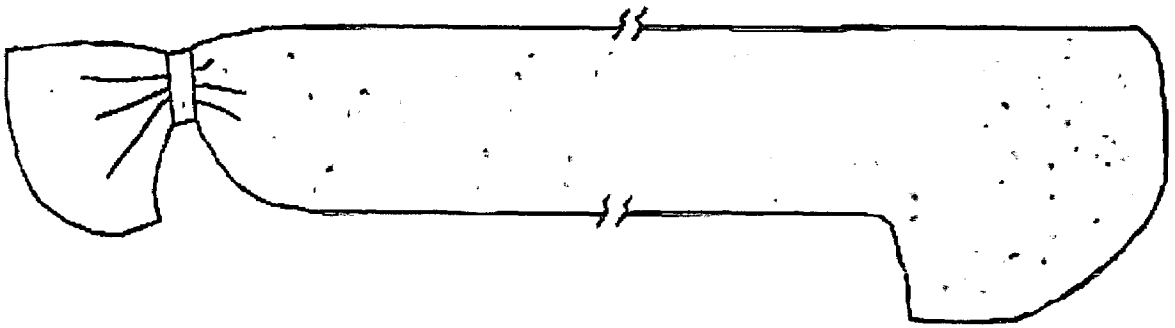
FIGS. 2A to 2C are perspective views of the constructed versatile scarf showing basic scarf and large and small versions of the scarf, according to exemplary embodiments of the present invention. Both sides of the scarf have similar configurations.
Figure 2B:
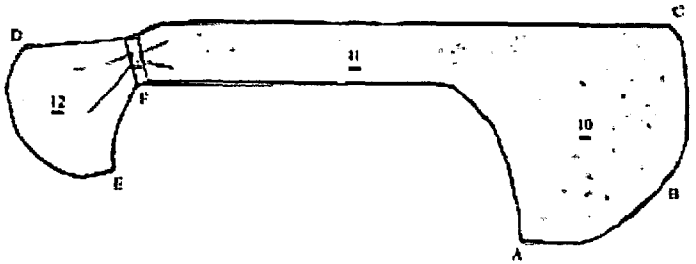
Figure 2C:
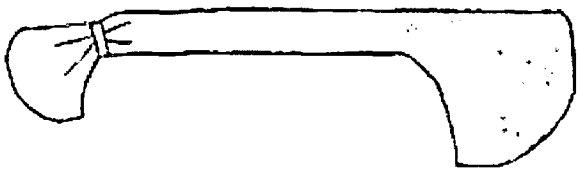

FIGS. 2A to 2C illustrate the constructed versatile scarf in three different dimensions. Since the back of the scarf has exactly the same or similar configuration, only front views are shown. The large version as shown in FIG. 2A is a modification of the basic version shown in FIG. 2B, with a longer and wider neckband portion and different dimensions for the two flaps. The modified scarf as shown in FIG. 2A may be used as various body wraps, whereas the small version of the scarf as shown in FIG. 2C with a narrower neckband and smaller flaps may be used by a younger user to achieve a cute and more sporty look, without departing from the spirit and scope of the invention.

FIGS. 3 to 17 illustrate distinctive looks which can be achieved by different tying methods of exemplary embodiments of the present invention. The resulting appearances of the versatile scarf are not limited to these illustrations, which are provided only as examples.

Figure 3:
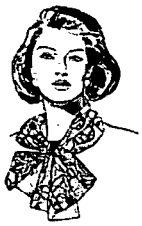
FIGS. 3 to 20 are illustrations of the various appearances which can be achieved (but not limited to these looks) by using the versatile scarf, according to exemplary embodiments of the present invention.

In order to achieve the look as shown in FIG. 3, the user takes the large flap of the first portion 10 at corner B, lets corner A drop down, pulls the large flap through the back of the tubular loop from the bottom until corners A and C are just shown (the pull-through portion may be about the same size of the small flap). Both the small and large flaps are then fanned.

Figure 4:
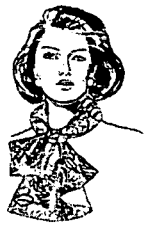

In order to achieve the look as shown in FIG. 4, the user pulls the entire large flap of the first portion 10 through the back of the tubular loop from the bottom, then adjusts the positions of both the small and large flaps.

Figure 5:
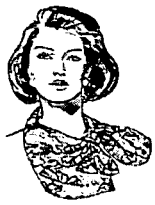

In order to achieve the look as shown in FIG. 5, the user takes the large flap of the first portion 10 at corner B, pulls the large flap through the front of the tubular loop from the bottom until the large flap is about halfway through the tubular loop, then tilts the large flap to the side.

Figure 6:
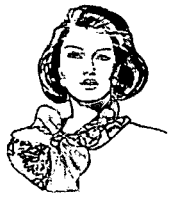

In order to achieve the look as shown in FIG. 6, the user takes the large flap of the first portion 10 at corner B, flips corner A over to show the back side, pulls the large flap through the front of the tubular loop from the bottom until the back of corner C emerges from the tubular loop, and a bow from the back side of the scarf 1 is made in the front side.

Figure 7:
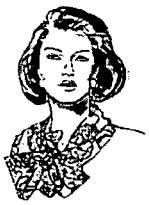

In order to achieve the look as shown in FIG. 7, the user follows the tying procedure for FIG. 3, but instead pulls the large flap through the front of the tubular loop from the bottom.

Figure 8:
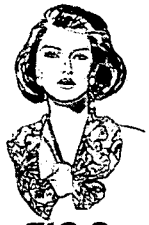

In order to achieve the look as shown in FIG. 8, the user follows the tying procedure for FIG. 6, but instead pulls the large flap through the back of the tubular loop halfway. The user then takes the small flap of the third portion 12 at corner E, flips the scarf 1 over to show the back side, and pulls the small flap through the front of the tubular loop from the top until the desired look is achieved.

Figure 9:
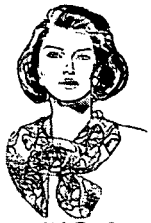

In order to achieve the look as shown in FIG. 9, the user follows the tying procedure for FIG. 3, but only pulls the large flap of the first portion 10 through the back of the tubular loop halfway. The user then takes the small flap of the third portion 12 at corner E, turns the small flap around and pulls corner E through the front of the tubular loop from the top to make a rosette.

Figure 10:
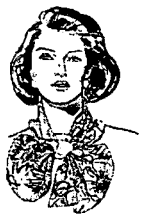

In order to achieve the look as shown in FIG. 10, the user follows the tying procedure of FIG. 3, but instead takes the small flap of the third portion 12 between corners D and E, flips the scarf 1 over and pulls the small flap through the front of the tubular loop from the top to make a knot.

Figure 11:
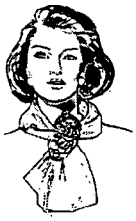

In order to achieve the look as shown in FIG. 11, using the back side of the scarf 1, the user follows the tying procedure of FIG. 4, but instead flips the small flap of the third portion 12 showing the front side, and pulls corner D through the back of the tubular loop.

Figure 12:
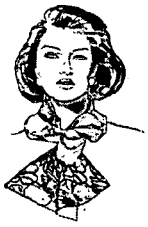

In order to achieve the look as shown in FIG. 12, the user follows the tying procedure for FIG. 4, but instead takes the small flap of the third portion 12 at corner E, flips the scarf 1 over to the back side, pulls corner E through the bottom of the front of the tubular loop until about one-third of the flap is through the tubular loop. The user then takes corner D, turns the scarf 1 around and pulls corner D through the top of the front of the tubular loop (re-looping) to obtain the resulting look as shown in FIG. 12.

Figure 13:
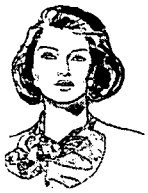

In order to achieve the look as shown in FIG. 13, working with the back side of the scarf 1, the user folds the scarf 1 partially showing the front side of the scarf 1 around the neck. The tying procedure of FIG. 9 is followed, but instead the user flips the pulled through part of the small flap to show the front side. The user can make a rosette from the small flap of the second portion 12 showing the front side of the scarf, as shown in FIG. 9.

Figure 14:
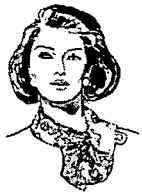

In order to achieve the look as shown in FIG. 14, the user follows the tying procedure for FIG. 3, but instead flips the small flap of the third portion 12 over and pulls it through the front of the tubular loop.

Figure 15:
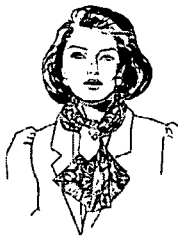

In order to achieve the look as shown in FIG. 15, the user follows the tying procedure for FIG. 4, but instead takes the small flap of the third portion 12 at corner E, flips the scarf 1 over to show the back side, and pulls corner E through the front of the tubular loop from the top until the desired look is achieved.

Figure 16:
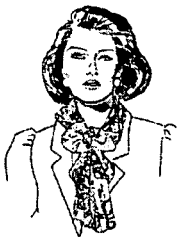

In order to achieve the look as shown in FIG. 16, the user follows the tying procedure for FIG. 4, but instead takes the small flap of the third portion 12 at corner D, flips the scarf 1 over to show the back side, and pulls corner D through the front of the tubular loop from the bottom to make a bow.

Figure 17:
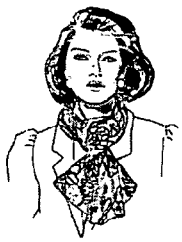

In order to achieve the look as shown in FIG. 17, the user follows the tying procedure for FIG. 4, but instead takes the small flap of the third portion 12 at corner E, and pulls corner E through the front of the tubular loop from the top to make a rosette.

Figure 18:
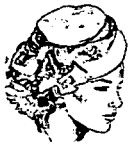

FIG. 18 is a perspective view of an exemplary embodiment of the versatile scarf of the present invention used as hat band. The tying method for this exemplary embodiment is illustrated in FIG. 3.

Figure 19:
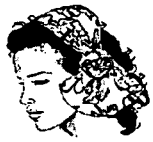

FIG. 19 is a perspective view of an exemplary embodiment of the versatile scarf of the present invention used as head scarf. The tying method for this exemplary embodiment is illustrated in FIG. 3.

Figure 20:
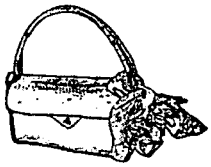

FIG. 20 is a perspective view of an exemplary embodiment of the versatile scarf of the present invention used as handbag enhancer. The tying method for this exemplary embodiment is illustrated in FIG. 3.

FIGS. 21 to 27 illustrate exemplary embodiments of larger versions of the versatile scarf that can be used as head/body wraps. Various tying methods as disclosed above may be used to achieve the desired look.

Figure 21:
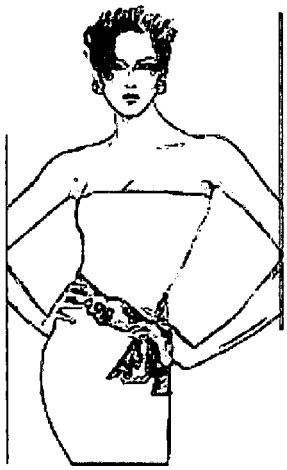
FIGS. 21 to 27 are illustrations of various body wrap configurations in which a larger version of the versatile scarf according to an exemplary embodiment of the present invention can be tied (but are not limited to these drawings).

In particular, FIG. 21 illustrates the versatile scarf of an exemplary embodiment of the present invention as a waist wrap.

Figure 22:
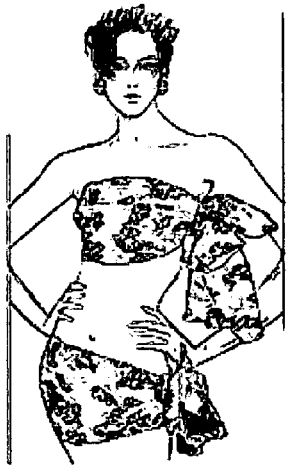

FIG. 22 illustrates the versatile scarf of an exemplary embodiment of the present invention as a body wrap and hip wrap.

Figure 23:
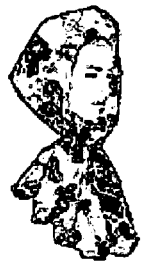

FIG. 23 illustrates the versatile scarf of an exemplary embodiment of the present invention as a head cover.

Figure 24:
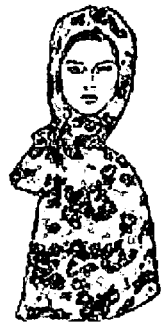

FIG. 24 illustrates the versatile scarf of an exemplary embodiment of the present invention as a head cover as well as a chest scarf.

Figure 25:
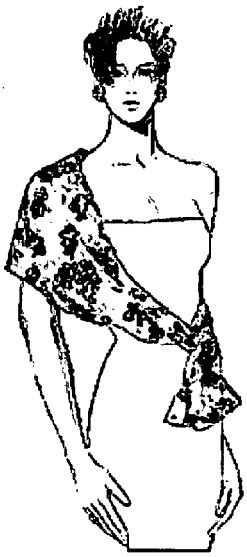

FIG. 25 illustrates the versatile scarf of an exemplary embodiment of the present invention as a shoulder wrap.

Figure 26:
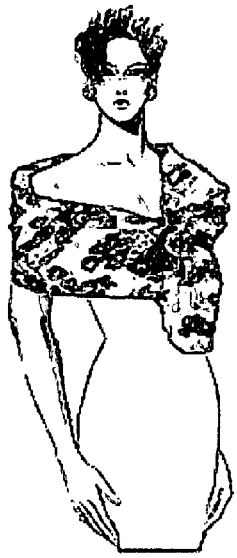
Figure 27:
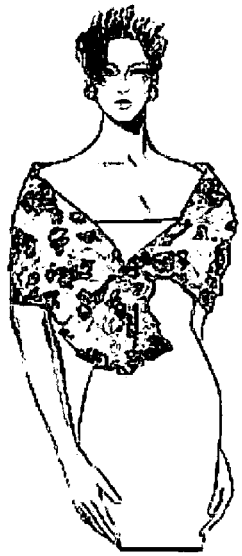

FIGS. 26 and 27 illustrate the versatile scarf of exemplary embodiments of the present invention as shawls.

Figure 28:
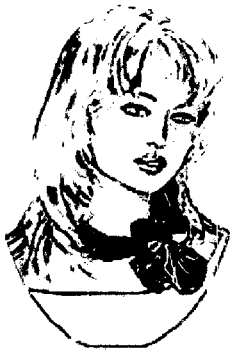
FIGS. 28 to 36 are drawings illustrating the reversibility of the scarf according to an exemplary embodiment of the present invention, and various ways a small version of the versatile scarf according to an exemplary embodiment of the present invention can be used to add charm to young girls' appearances (but are not limited to these drawings).
Figure 29:
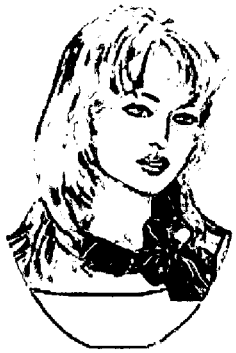
Figure 30:
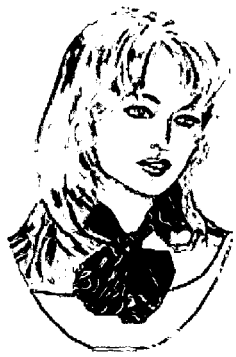
Figure 31:
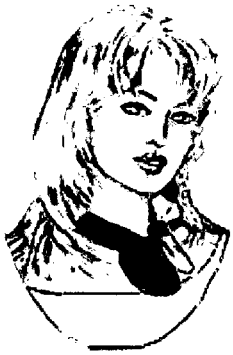
Figure 32:
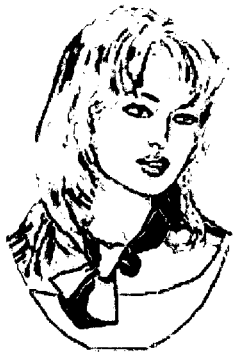
Figure 33:
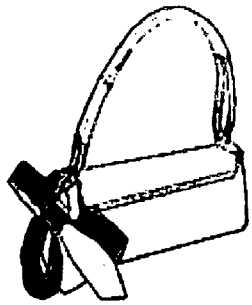
Figure 34:
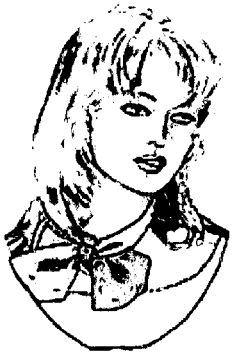
Figure 35:
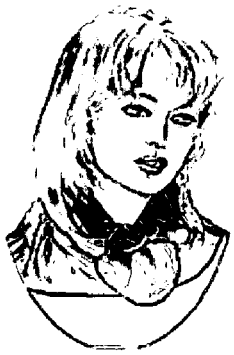
Figure 36:
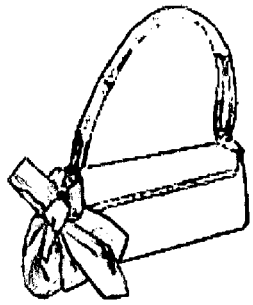

FIGS. 28 to 30 illustrate the use of small versions of the versatile scarf according to exemplary embodiments of the present invention which do not produce the same sophisticated looks of the basic version of the scarf 1, but may be more suitable for young girls.

In order to achieve the look of FIG. 28, the user follows the tying procedure for FIG. 16.

In order to achieve the look of FIG. 29, the user pulls the large flap of the first portion 10 through the front of the tubular loop, then re-loops to make a bow.

In order to achieve the look of FIG. 30, the user twists the neckband and then follows the tying procedure for FIG. 3.

FIGS. 31 to 36 illustrate the use of a versatile scarf in accordance with exemplary embodiments of the present invention as neck-ware and also as an accent to be tied on a handbag providing a desired fashion statement. The versatile scarf according to exemplary embodiments of the present invention may be manufactured by using any of today's most fashionable color combinations of colors, including but not limited to orange/hot pink and turquoise/neon green.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A scarf comprising:

a front portion;

a back portion;

an elongated neckband portion;

a large fan-shaped flap portion connected to a first end of said elongated neckband portion;

a small fan-shaped flap portion connected to a second end of said elongated neckband portion;

a first loop portion permanently attached to said front portion at said second end of said elongated neckband portion, said first loop portion cinching said small fan-shaped flap portion; and a second loop portion permanently attached to said back portion at said second end of said elongated neckband portion, said second loop portion cinching said small fan-shaped flap portion.

2. The scarf of claim 1, wherein said front portion is made from a first piece of material and said back portion is made from a second piece of material, said first and second pieces of material having the same configuration and attached to one another to form a completely reversible scarf.

3. The scarf of claim 1, wherein said elongated neckband portion is rectangular in shape.

4. The scarf of claim 1, wherein said first loop portion and said second loop portion securely fasten the scarf on a user or on another object as tied by a user.

5. The scarf of claim 1, wherein said large fan-shaped portion is pulled through and fastened by said first and second loop portions.

6. The scarf of claim 1, wherein the first and second loop portions are permanently attached to each other and to the second end of said elongated neckband portion.

7. The scarf of claim 1, wherein the first and second loop portions provide a means for looping and re-looping said large fan-shaped flap or small fan-shaped flap to create a knot, a rosette, a bow or other stylish looks.

* * * * *